US007942376B1

(12) United States Patent
Young

(10) Patent No.: US 7,942,376 B1
(45) Date of Patent: May 17, 2011

(54) WIRE DECK WITH INTEGRAL REINFORCEMENT

(76) Inventor: Ronald A. Young, Mooresville, NC (US)

( * ) Notice: Subject to any disclaimer, the term of this patent is extended or adjusted under 35 U.S.C. 154(b) by 395 days.

(21) Appl. No.: 12/276,478

(22) Filed: Nov. 24, 2008

(51) Int. Cl.
*A47B 91/00* (2006.01)

(52) U.S. Cl. ..... 248/346.02; 108/57.14; 248/175

(58) Field of Classification Search ..... 248/346.02, 248/346.01, 175, 49, 678; 108/57.14, 57.32, 108/51.11; 211/119, 153, 90.03, 106, 133.5, 211/133.2, 181.1
See application file for complete search history.

(56) References Cited

U.S. PATENT DOCUMENTS 5,588,372 A * 12/1996 Kelly ..... 108/55.1
6,398,045 B1 * 6/2002 Chao ..... 211/181.1
6,494,149 B1 * 12/2002 De Groot ..... 108/56.3
6,644,220 B2 * 11/2003 Gangloff et al. ..... 108/57.32
6,892,993 B2 * 5/2005 Palmer ..... 248/346.02
7,798,465 B1 * 9/2010 Meverden ..... 248/678
2009/0008512 A1 * 1/2009 Davis et al. ..... 248/49
2009/0308825 A1 * 12/2009 Lin ..... 211/181.1
2010/0320334 A1 * 12/2010 Crain et al. ..... 248/49

* cited by examiner

*Primary Examiner* — Ramon O Ramirez
(74) *Attorney, Agent, or Firm* — Gauthier & Connors LLP

(57) ABSTRACT

A wire deck for supporting a load between two spaced parallel supports comprises a parallel array of first wires dimensioned to extend between the supports, and a parallel array of second wires extending across and joined to the first wires. The second wires have intermediate shaped sections projecting downwardly from an adjacent pair of first wires. The shaped sections define a channel-shaped path parallel to the first wires, with one of the first wires located at the base of that path.

11 Claims, 4 Drawing Sheets

WIRE DECK WITH INTEGRAL REINFORCEMENT

BACKGROUND DISCUSSION

1. Field of the Invention

This invention relates to wire decks for supporting loaded pallets and the like between spaced supports.

2. Description of the Prior Art

Conventional wire decks have a tendency to sag and deform when subjected to heavy loads. To counteract this tendency, metal support channels have been welded to the undersides of the decks. While this achieves the intended result, it does so at a disadvantageously high cost, due both to the cost of the support channels and to the labor entailed in welding them in place.

The principal objective of the present invention is to achieve the desired strengthening and resistance to bending in a more cost effective way, which eliminates the need for welding additional structural elements to the undersides of the wire decks.

SUMMARY OF THE INVENTION

In accordance with one aspect of the present invention, a wire deck comprises a parallel array of first wires dimensioned to extend between two parallel supports. A parallel array of second wired extends across and is joined as by resistance welding to the first wires. The second wires have intermediate shaped sections that project downwardly from an adjacent pair of the first wires to thereby define one or more channel-shaped paths parallel to the first wires, with one of the first wires being located at the base of each channel-shaped path. When the wire deck is loaded, the wire at the base of each channel-shaped path is tensioned and thereby serves to effectively resist any tendency of the wire deck to sag under load.

In accordance with another aspect of the present invention, a method of producing a wire deck useful in supporting a load between two parallel supports comprises providing a parallel array of first wires dimensioned to extend between the supports; providing a parallel array of second wires extending across the first wires; joining the first wires to the second wires at points of intersection therebetween; and deforming the second wires between adjacent pairs of the first wires to form intermediate shaped sections defining channel-shaped paths parallel to the first wires, with one of the first wires being located at the base of each channel-shaped path.

These and other features and advantages of the present invention will now be described in further detail with reference to the accompanying drawings, wherein:

DETAILED DESCRIPTION

Figure 1:
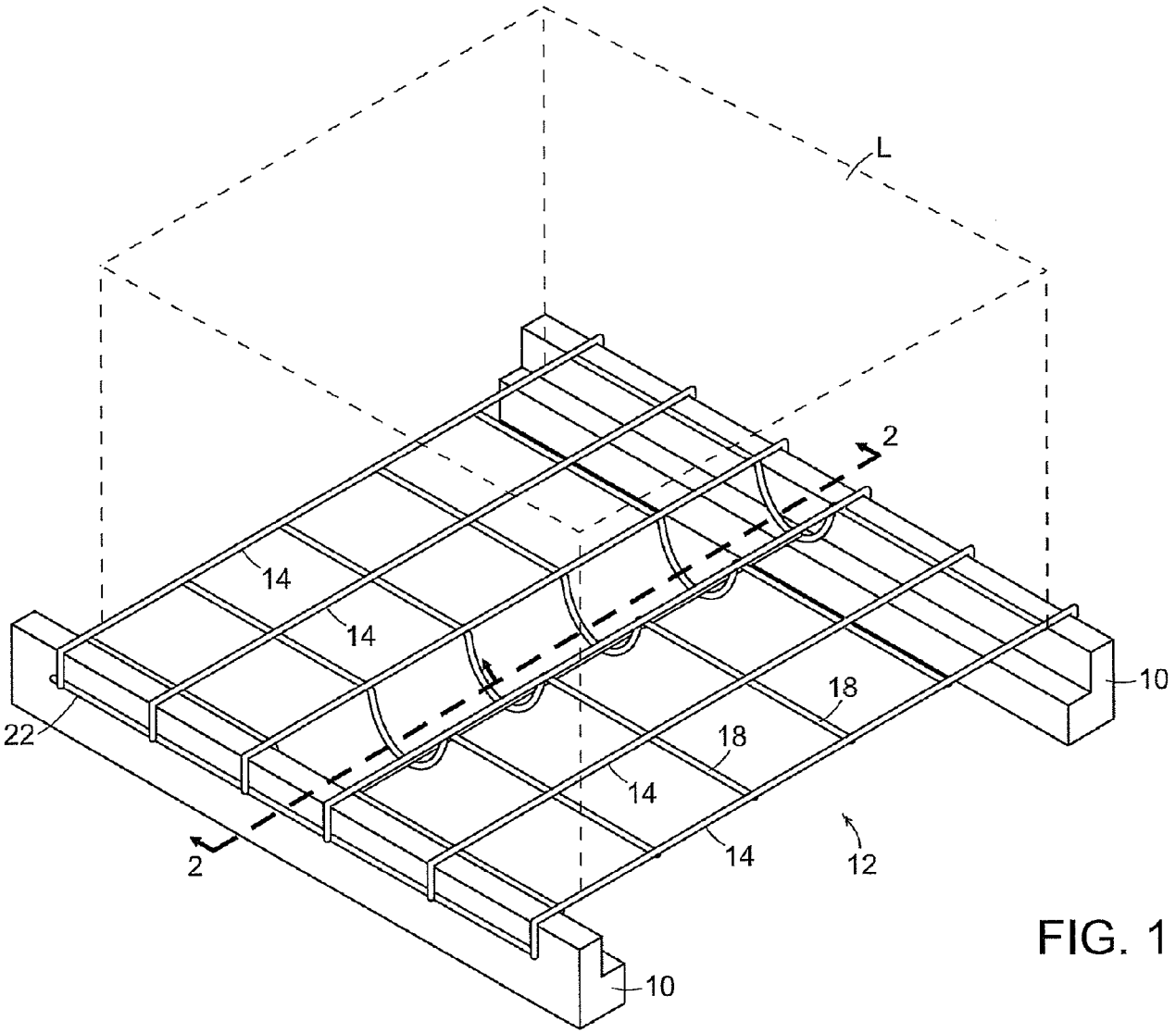
FIG. 1 is a perspective view showing a load supported by a wire deck in accordance with one embodiment of the present invention.
Figure 2:
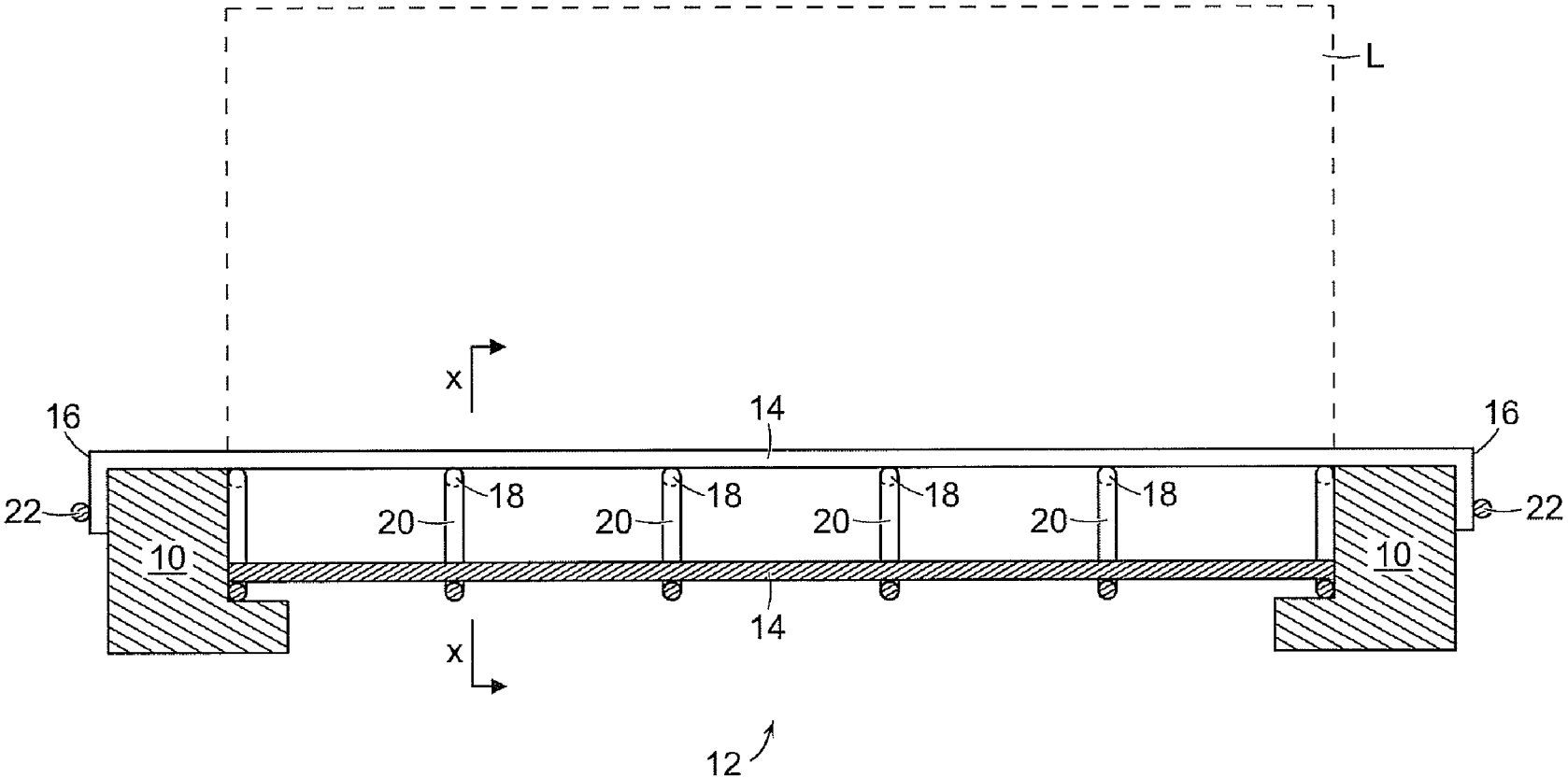
FIG. 2 is a sectional view taken along line 2-2 of FIG. 1.

With reference initially to FIGS. 1 and 2, a load L is supported between two spaced parallel supports 10 on a wire deck 12 in accordance with one embodiment of the present invention. The wire deck includes a parallel array of first wires 14 dimensioned to extend between the supports 10. Preferably, the first wires have downturned ends indicated typically at 16 configured and arranged to overlap and mechanically engage the supports 10.

Figure 3A:
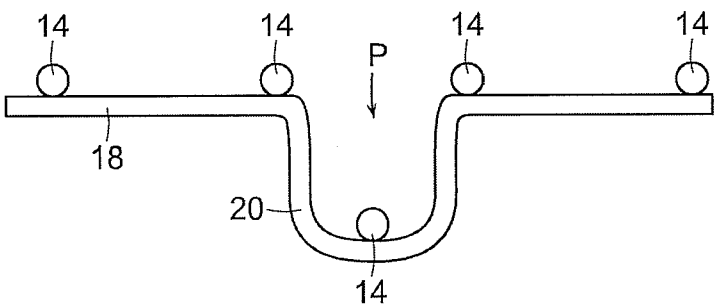
FIGS. 3A-3D are sectional views taken along line X-X of FIG. 2 showing different embodiments of the invention.

A parallel array of second wires 18 extends across the first wires. The first and second wires are typically steel wires, and are joined at their point of intersection, typically by welding. With further reference to FIG. 3A, it will be seen that the second wires 18 have intermediate shaped sections 20 projecting downwardly from an adjacent pair of first wires. The shaped sections 20 are aligned to define a channel-shaped path P parallel to the first wires, with one of the first wires located at the base of the channel-shaped path.

Preferably, the second wires 18 underlie the first wires. Third wires 22 overlie and are joined to the downturned ends of the first wires.

Figure 3B:
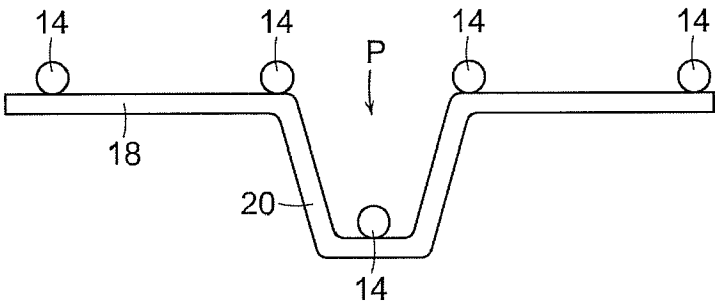
Figure 3C:
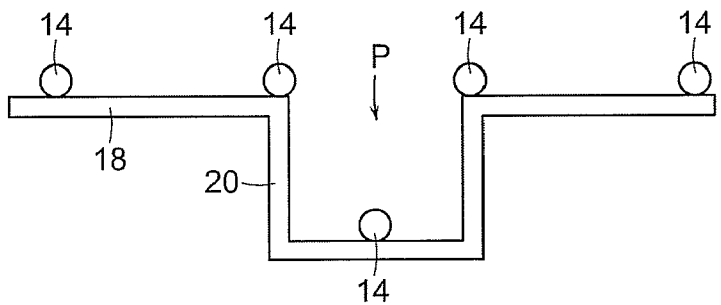
Figure 3D:
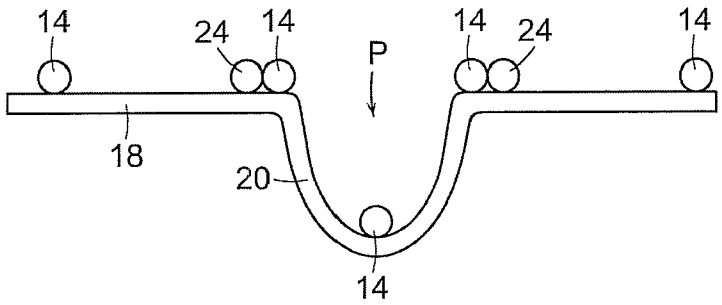

Optionally, as shown in FIG. 3D, fourth wires 24 may be joined to the second wires at locations contiguous to the first wires bordering the channel-shaped path P. As will be seen in FIG. 2, the first wire 14 at the base of the channel-shaped path P is shorter than the other first wires, the latter being dimensioned to overlap the supports 10.

The intermediate shaped sections 20 of the second wires can have different configurations. For example, as shown in FIG. 3B, the shaped sections may have flat bottoms with diverging sides, or as shown in FIG. 3C, flat bottoms with perpendicular sides.

Figure 4:
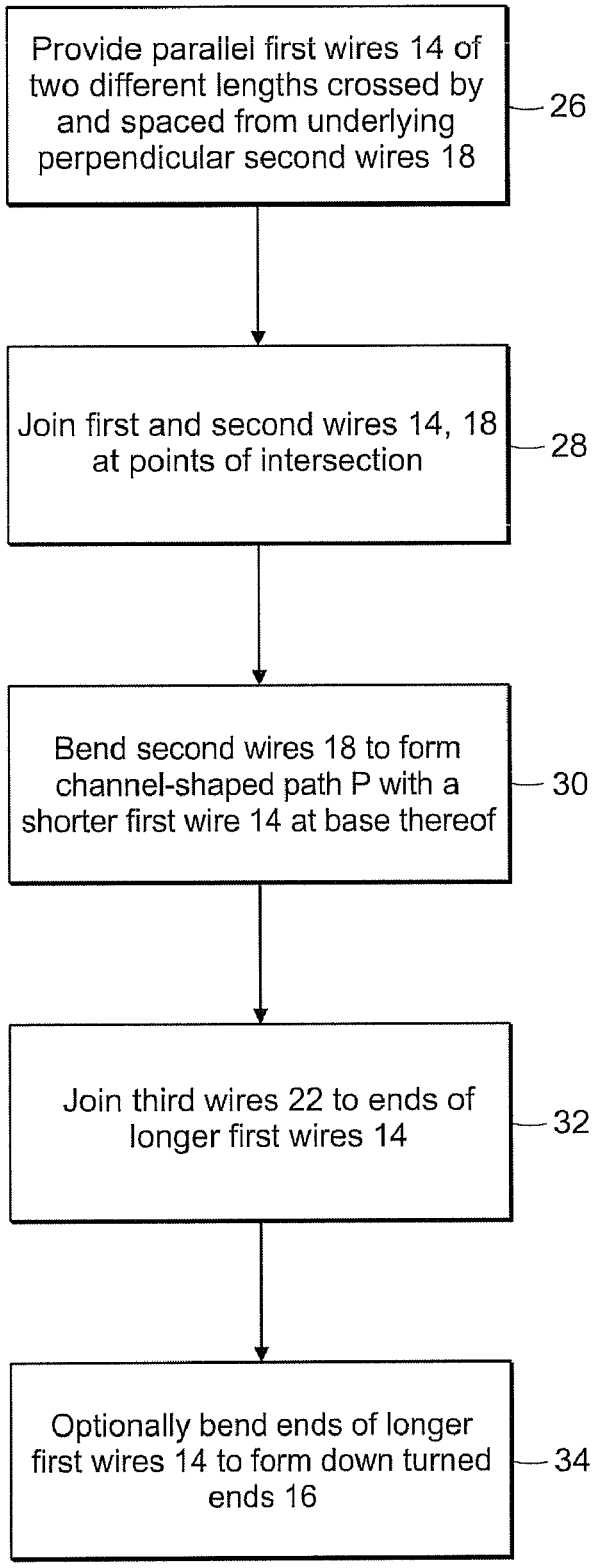
FIG. 4 is a block diagram depicting the method of making the present invention.

With reference to FIG. 4, and in accordance with the method of making the present invention, block 26 illustrates the step of providing parallel first wires 14 of two different lengths crossed by and spaced from underlying perpendicular second wires. At block 28, the first and second wires are joined at their points of intersection. At block 30, the second wires 18 are bent as at 20 to form the channel-shaped path P with the shorter first wire 14 at the base thereof. At block 32, which may occur either concurrently with or subsequent to the step of block 30, the ends of the second wires are joined by the third wires 22. Optionally, and again concurrently with or subsequent to the step of block 30, the fourth wires 24 may be joined to the second wires 18. At block 34, the ends of the longer first wires 14 are bent to form the downturned ends 16.

In light of the foregoing, it will now be appreciated by those skilled in the art that the wire deck of the present invention incorporates integral stiffening elements in the form of the shaped intermediate sections 20 of the second wires 18 acting in concert with a first wire 14 at the base of the channel-shaped path P, the latter wire being tensioned when the deck is loaded.

Additional strengthening and stiffening may be achieved by incorporating the optional fourth wires 24.

I claim:

1. A wire deck for supporting a load between two spaced parallel supports, said deck comprising:

a parallel array of first wires dimensioned to extend between said supports;

a parallel array of second wires extending across and joined to said first wires, said second wires having intermediate shaped sections projecting downwardly from an adjacent pair of said first wires, said shaped sections defining a channel-shaped path parallel to said first wires, one of said first wires being located at the base of said channel-shaped path.

2. The wire deck of claim 1 wherein other than the first wire at the base of said channel-shaped path, said first wires have downturned ends configured and arranged to overlap and mechanically engage said supports.

3. The wire deck of claim 1 or 2 wherein said second wires underlie said first wires.

4. The wire deck of claim 3 further comprising third wires overlying and extending across the ends of said first wires.

5. The wire deck of claim 1 or 2 wherein the base of said channel-shaped path is interiorly generally concave.

6. The wire deck of claim 1 or 2 wherein the base of said channel-shaped path is flat with side walls diverging upwardly to the said adjacent pair of first wires.

7. The wire deck of claim 1 or 2 wherein the base of said channel-shaped path is flat with perpendicular side walls extending upwardly to the said adjacent pair of first wires.

8. The wire deck of claim 1 or 2 further comprising fourth wires arranged contiguously to the said adjacent pair of first wires.

9. A method of producing a wire deck useful in supporting a load between two spaced parallel supports, said method comprising:

providing a parallel array of first wires dimensioned to extend between said supports;

providing a parallel array of second wires extending across and perpendicular to said array of first wires;

joining said first wires to said second wires at intersections therebetween; and deforming said second wires downwardly between an adjacent pair of said first wires to form shaped sections of said second wires defining a channel-shaped path parallel to said first wires, with one of said first wires located at the base of said channel-shaped path.

10. The method of claim 9 further comprising joining the ends of said second wires by third wires extending in parallel relationship to said second wires.

11. The method of claim 9 or 10 further comprising joining fourth wires to said second wires at locations contiguous with the said adjacent pair of first wires.

* * * * *